US007070212B2

(12) United States Patent
Spurr

(10) Patent No.: US 7,070,212 B2
(45) Date of Patent: Jul. 4, 2006

(54) LATCH ARRANGEMENT

(75) Inventor: Nigel Victor Spurr, Birmingham (GB)

(73) Assignee: Meritor Light Vehicle Systems (UK) Limited, Birmingham (GB)

( * ) Notice: Subject to any disclaimer, the term of this patent is extended or adjusted under 35 U.S.C. 154(b) by 0 days.

(21) Appl. No.: 10/024,915

(22) Filed: Dec. 19, 2001

(65) Prior Publication Data

US 2002/0074810 A1 Jun. 20, 2002

(30) Foreign Application Priority Data

Dec. 20, 2000 (GB) ..... 0031062.3

(51) Int. Cl.
*E05C 3/06* (2006.01)

(52) U.S. Cl. ..... 292/216; 292/DIG. 23

(58) Field of Classification Search ..... 292/201, 292/216, DIG. 23, DIG. 25; 70/277, 283, 70/279.1, 278.7, 257
See application file for complete search history.

(56) References Cited

U.S. PATENT DOCUMENTS

| | | | | |
|---|---|---|---|---|
| 3,798,398 | A * | 3/1974 | Hills | 70/429 |
| 3,860,277 | A * | 1/1975 | Wang | 292/251.5 |
| 4,727,301 | A * | 2/1988 | Fulks et al. | 318/468 |
| 4,802,350 | A | 2/1989 | Periou | |
| 5,169,186 | A * | 12/1992 | Fukumoto et al. | 292/201 |
| 5,238,274 | A * | 8/1993 | Becker et al. | 292/201 |
| 5,263,751 | A * | 11/1993 | Priest et al. | 292/336.3 |
| 5,441,315 | A * | 8/1995 | Kleefeldt et al. | 292/201 |
| 5,511,838 | A * | 4/1996 | Baughman et al. | 292/336.3 |
| 5,765,884 | A * | 6/1998 | Armbruster | 292/216 |
| 6,116,664 | A | 9/2000 | Wegner | |
| 6,419,286 | B1 * | 7/2002 | Szablewski | 292/216 |
| 6,463,773 | B1 * | 10/2002 | Dimig | 70/277 |
| 6,471,259 | B1 * | 10/2002 | Weyerstall et al. | 292/201 |
| 6,485,071 | B1 * | 11/2002 | Schwaiger | 292/216 |
| 6,494,505 | B1 * | 12/2002 | Kobayashi et al. | 292/201 |

FOREIGN PATENT DOCUMENTS

| | | |
|---|---|---|
| DE | 43 13 248 | 11/1994 |
| EP | 0 103 904 | 3/1984 |
| EP | 0 142 319 | 5/1985 |
| EP | 0 589 158 | 3/1994 |
| EP | 1 004 730 | 5/2000 |
| FR | 2 778 940 | 11/1999 |
| GB | 2 301 143 | 11/1996 |
| GB | 2 342 383 | 4/2000 |
| GB | 2 349 171 | 10/2000 |
| GB | 2 350 644 | 12/2000 |

* cited by examiner

*Primary Examiner*—Gary Estremsky
(74) *Attorney, Agent, or Firm*—Carlson, Gaskey & Olds

(57) ABSTRACT

A latch arrangement including a latch, a release mechanism a manually actuable element and a control means, the latch being operable to releasably retain a striker in use, the release mechanism being capable of being moved by the manually actuable element from a rest position through an unlocked position to a release position wherein it unlatches the latch, the control means having a locked condition at which actuation of the manually actuable element does not cause unlatching of the latch and an unlocked condition at which during an initial movement of the manually actuable element, the release mechanism achieves the unlocked position and during subsequent movement of the manually actuable element, the release mechanism achieves the unlatch position.

46 Claims, 3 Drawing Sheets

REST

UNLOCKED

RELEASED

LATCH ARRANGEMENT

This application claims priority to United Kingdom (GB) application number 0031062.3 filed on Dec. 20, 2000.

BACKGROUND OF THE INVENTION

The present invention relates to latch arrangements, and in particular latch arrangements for use within doors of cars (automobiles).

Known car doors include latches for releasably retaining the car door in a closed position. Such latches can be locked when the car is left unattended or even when an occupant is in the vehicle so as to prevent access to the vehicle by unauthorised people.

Such latches can be moved between a locked and unlocked condition either by manual means such as by operating an inside sill button or an exterior key barrel, or they can be powered between the locked and unlocked conditions by a power actuator, which can be controlled remotely by, for example, infrared devices.

A problem with such power locking/unlocking is that in the event that power is lost, for example, during a road traffic accident or as a result of a flat battery, it may not be possible to change the state of the lock. Thus where a vehicle is in use and the doors are locked and the vehicle is involved in a road traffic accident, the occupant of the vehicle may find themselves locked in the vehicle immediately following the crash. This clearly has safety implications. Furthermore the power actuator is expensive to produce and manufacture.

SUMMARY OF THE INVENTION

An object of the present invention is to provide an improved form of latch arrangement.

Thus according to the present invention there is provided a latch arrangement including a latch, a release mechanism, a manually actuable element and a control means. The latch is operable to releasably retain a striker in use and the release mechanism is capable of being moved by the manually actuable element from a rest position through an unlocked position to a release position to unlatche the latch. The control means having a locked condition at which actuation of the manually actuable element does not cause unlatching of the latch and an unlocked condition at which during an initial movement of the manually actuable element, the release mechanism achieves the unlocked position and during subsequent movement of the manually actuable element, the release mechanism achieves the unlatch position.

Advantageously movement of a door handle therefore provides two functions, namely that of unlocking of the latch mechanism and also release of the latch mechanism. Furthermore the control means can be configured to ensure the latch arrangement remains in a locked condition, independent of actuation of any door handles (inside or outside doors) when necessary.

BRIEF DESCRIPTION OF THE DRAWINGS

The invention will now be described, by way of example only, with reference to the accompanying drawings in which.

DETAILED DESCRIPTION OF THE PREFERRED EMBODIMENT

Figure 1:
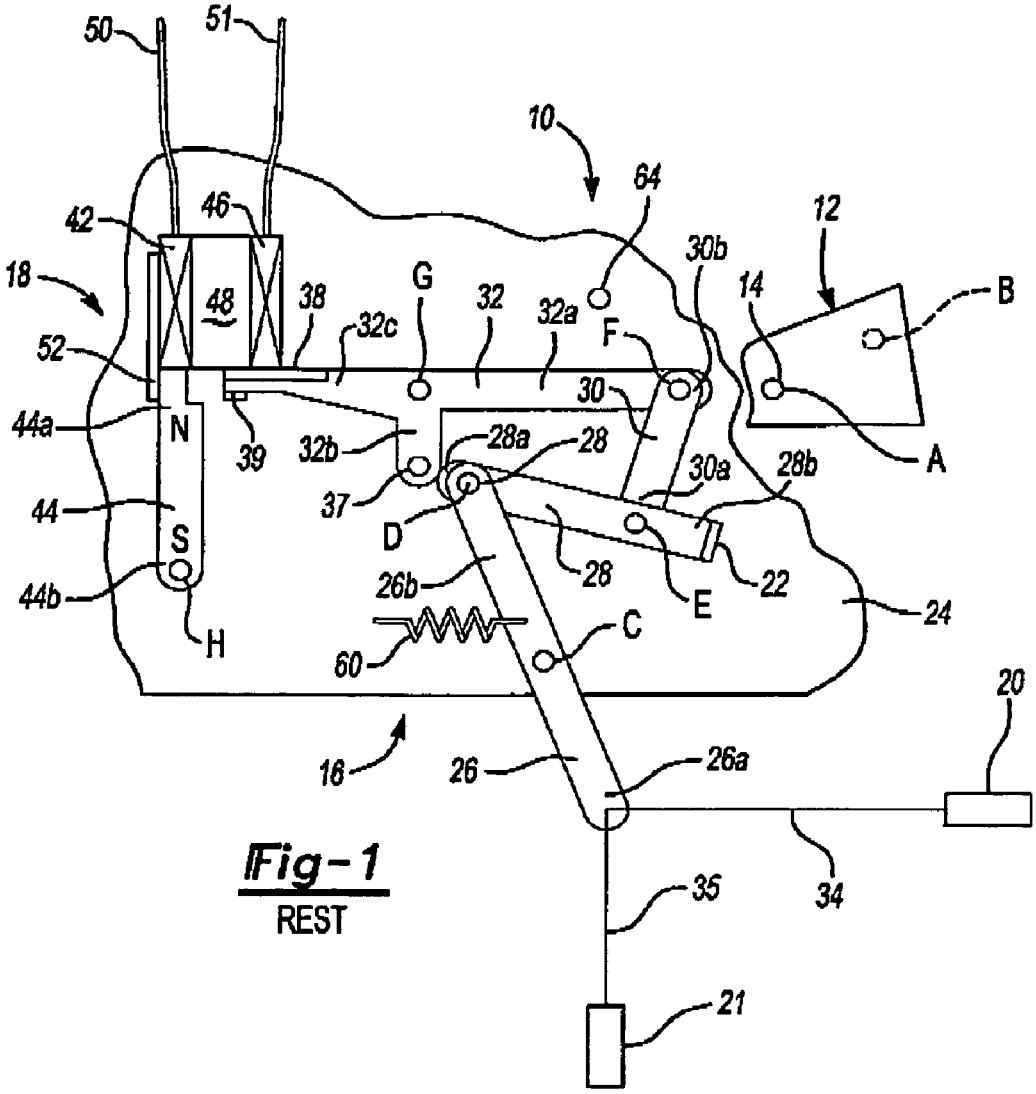
FIG. 1 is a view of a latch arrangement according to the present invention.

With reference to the figures there is shown a latch arrangement 10 having a latch 12 (only part of which is shown schematically), a release mechanism 16, powered control means 18 and manually actuable elements in the form of inside handle 20 and outside handle 21.

The latch 12 is mounted on a car door and is operable to releasably retain a striker mounted on fixed structure of the car, such as a B post or a C post. The latch 12 typically might include a latch bolt in the form of a rotating claw which engages the striker. To ensure the claw retains the striker, a pawl can be provided to retain the latch bolt in its closed position. The pawl includes a latch release element in the form of a pawl pin 14.

With the pawl pin 14 in position A as shown in FIG. 1, closing of the door will cause the rotating claw to engage the striker and the pawl will then retain the striker in the closed position. Movement of the pawl pin 14 to the position B as shown in FIG. 1 will release the pawl from engagement with the claw thus allowing the striker to be released from the claw and allowing the door to open. Thus with the pawl pin in the position A of FIG. 1 the latch can be latched to the striker and with the pawl pin in the position B of FIG. 1 the latch can be unlatched from the striker.

The release mechanism includes release lever 26, release link 28, connector link 30 and lock/unlock lever 32.

Release lever 26 is pivotally mounted about pivot C on chassis 24 of the latch arrangement. One end 26A of release lever 26 is connected via linkage 34 (shown schematically) to a manually actuable element in the form of an inside handle 20.

End 26A is further connected by a further linkage 35 (shown schematically) to a further manually actuable element in the form of an outside door handle 21.

Operation of either handle 20 or 21 causes the release lever to rotate clockwise about pivot C.

End 26B of release lever 26 is connected via pivot D to end 28A of release link 28.

End 28B of release link 28 includes an abutment 22 for engagement with pawl pin 14 as will be further described below.

Release link 28 is connected to end 30A of connector 30 by pivot E which is positioned between end 28A and 28B. End 30B of connector 30 is connected to end of arm 32A of lock/unlock lever 32 by a pivot F.

Lock/unlock lever 32 further includes arm 32B having pin 37 and arm 32C having abutment 38 and 39. Lock/unlock lever 32 is pivotally mounted about pivot G onto chassis 24.

Lock/unlock lever 32 is made from mild steel and hence in particular abutment 38 is made from a ferromagnetic material though in further embodiments this need not be the case (see below).

Powered control means 18 includes electromagnet 42 and magnetic pawl 44.

Electromagnetic 42 is mounted on chassis 24 and includes windings 46, core 48 and electric leads 50 and 51. Pawl stop 52 is provided on one side of the electromagnet 42.

Magnetic pawl 44 includes a permanent magnet and is pivotally mounted about pivot H onto chassis 24. End 44A of magnetic pawl 44 includes abutment 54, 56 and 58, which will be further described below.

A tension spring 60 is connected to chassis 24 and release lever 26 and acts to bias release lever 26 in a counterclockwise direction when viewing FIG. 1.

A further tension spring 62 (only shown in FIG. 3 for clarity) biases pin 37 and pivot 38 together.

In further embodiments different forms of springs can be used in particular springs acting in torsion (clock springs) in place of tension springs 60 and 62 to perform the same biasing action.

A lock/unlock lever stop 64 is mounted on the chassis 24.

As a result of tension spring 62 end 28A of release link 28 is biased into engagement with pin 37. In further embodiments the end of release lever 26 could engage pin 37 as could a part of pivot D.

Magnetic pawl 44 has a south pole at end 44B and a north pole at end 44A.

Applying DC current to the windings 46 via electric leads 50 and 51 in a first direction will create a magnetic field around the electromagnet which will bias the north pole in end 44A of magnetic pawl 44 to the left when viewing FIG. 1 counterclockwise about pivot H until abutment 54 engages pawl stop 52.

Figure 1A:
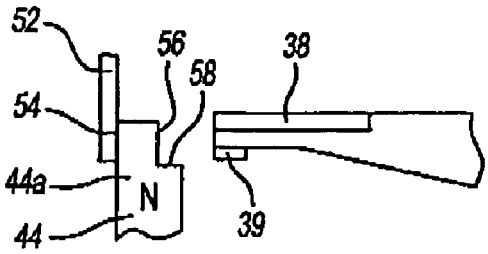
FIG. 1A is an enlarged view of part of the FIG. 1
Figure 1B:
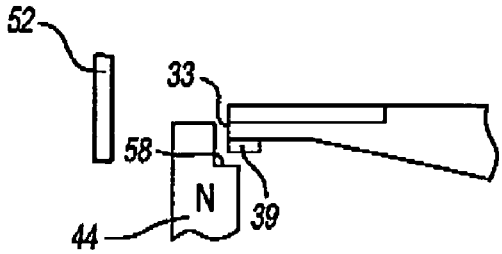
FIG. 1B is a view similar to FIG. 1A with the magnetic pawl in a different position.

Applying DC current in a second direction to windings 46 via electric 50 and 51 will cause a different magnetic field to form around the electromagnet such that north pole end 44A of magnetic pawl 44 is biased to the right when viewing FIG. 1 i.e. clockwise around pivot H until such time as abutment 56 engages end 33 of arm 32C of lock/unlock lever 32 (see FIG. 1B). Under these conditions abutment 58 is opposite abutment 39 and will prevent rotation of lock/unlock lever 32 anticlockwise about pivot G (see below).

Note that to move the magnetic pawl between the positions as shown in FIGS. 1A and 1B it is only necessary to apply a short pulse (e.g. 50 ms) of current to windings 46 in the appropriate direction since under normal circumstances once the magnetic pawl 44 has achieved one of the positions as shown in FIGS. 1A or 1B there are no forces which tend to move it out of that positions.

Note that in a preferred embodiment the centre of gravity of magnetic pawl 44 is substantially at pivot H since, in the event of a road traffic accident, such an arrangement will not tend to rotate the pawl as a result of acceleration or deceleration occurring during the accident.

Note that in a further preferred embodiment a relatively light detent is provided to maintain the magnetic pawl 44 in either of the positions as shown in FIG. 1A and FIG. 1B which can nevertheless be overcome by manual operation of the key or by pulsing the electromagnet.

It is also possible to prevent rotation of lock/unlock lever 32 counterclockwise about pivot G by applying and maintaining DC current in the first direction to windings 46 since abutment 38 is made from a ferromagnetic material and will therefore be magnetically attracted to electromagnet 42.

The powered control means 18 has three conditions namely a first condition at which no power is applied to the windings and the magnetic pawl 44 is in the position as shown in FIG. 1B.

A second condition at which power is supplied and maintained in a first direction to windings 46 thus attracting abutment 38 and ensuring that the magnetic pawl is positioned as shown in FIG. 1 and 1A.

A third condition at which no power is supplied to the windings 46 and the magnetic pawl 44 is in position as shown in FIG. 1.

Operation of the latch arrangement is as follows.

With the control means 18 in the third condition the door can be manually opened as follows.

As mentioned previously with the control means in the third condition the magnetic pawl is positioned as shown in FIG. 1 and thus does not restrict rotation of the lock/unlock lever 32 in a counterclockwise direction.

Furthermore no power is supplied to the windings 46 and thus the electromagnet also does not restrict movement of the lock/unlock lever 32 in a counterclockwise direction.

Figure 2:
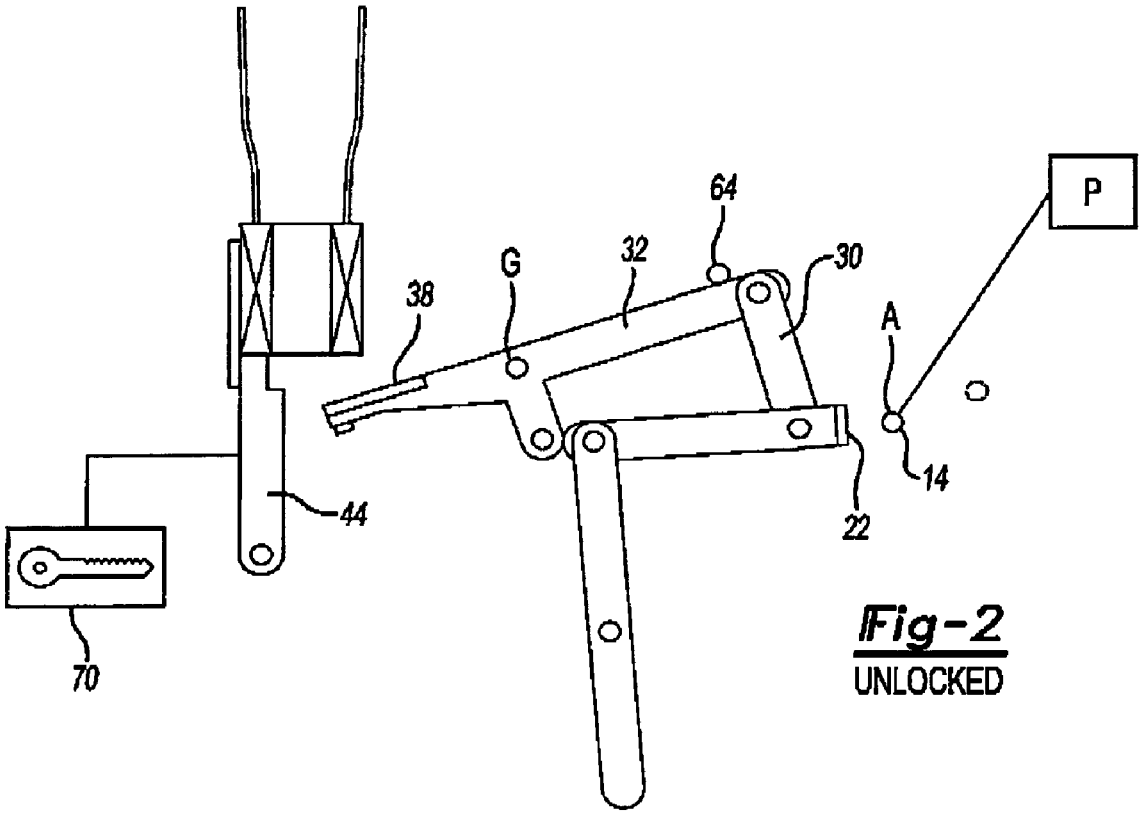
FIG. 2 shows the latch arrangement of FIG. 1 part way through an opening operation in an unlocked but latched condition.

Initial movement of either the inside handle 20 or outside handle 21 moves the release lever 26 in a clockwise direction about pivot C to the unlocked position as shown in FIG. 2.

It should be noted that lock/unlock lever has rotated counterclockwise about pivot G to a position where arm 32A has come into abutment with abutment 64. It should also be noted that abutment 38 has become disengaged from the electromagnet 42.

It can also be seen from FIG. 2 that end 28A of release link 28 has remained in contact with pin 37. Thus connector 30 and release link 28 have also substantially rotated about pivot G. Note that as shown in FIG. 2 abutment 22 had become aligned with pawl pin 14. This can be contrasted with the position of abutment 22 as shown in FIG. 1 where it is not aligned with pawl pin 14.

Figure 3:
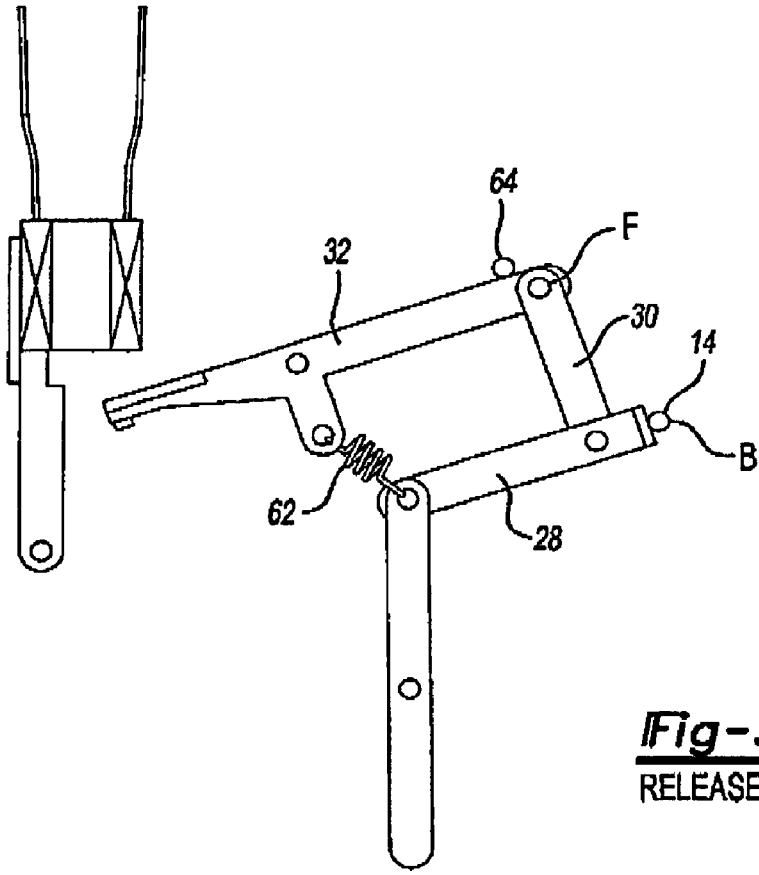
FIG. 3 shows the latch arrangement of FIG. 1 at the end of an opening operation in an unlatched condition.

Further movement of the inside or outside door handle moves the release lever 26 from the position as shown in FIG. 2 to the position as shown in FIG. 3.

In view of the fact that arm 32A of lock/unlock lever 32 is in abutting engagement with abutment 64, lock/unlock lever 32 cannot rotate further in a counterclockwise direction. Thus connector 30 is caused to rotate anticlockwise about pivot F relative to lock/unlock lever 32. This results in abutment 22 of release link 28 moving into engagement with pawl pin 14 and moving it from position A as shown in FIG. 2 to position B as shown in FIG. 3.

As previously mentioned movement of the pawl pin from position A to position B causes the latch to unlock.

When the inside and outside handles are released, spring 60 and spring 62 return the release mechanism 16 and pawl pin 14 to the position as shown in FIG. 1.

Note that whilst the movement of the inside or outside handle and hence movement of the release lever 26 has been described in two stages, such two stage movement is not discernible by a person operating the door handles. Furthermore the mechanism is designed to move seamlessly from the position as shown in FIG. 3 to the position as shown in FIG. 1.

With the control means in its second condition where DC current is supplied to the windings in the first direction and the magnetic pawl is in a position as shown in FIG. 1 the lock/unlock lever 32 is maintained in the position as shown in FIG. 1 by magnetic attraction.

Figure 4:
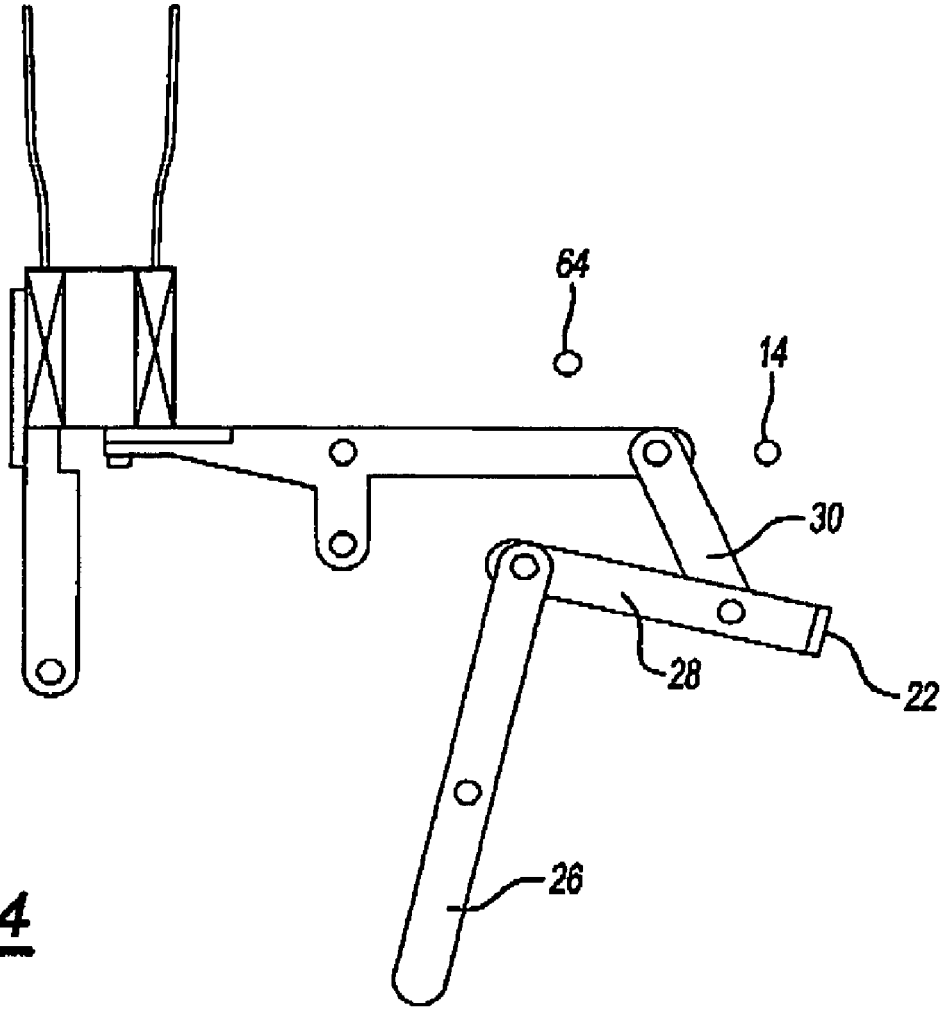
FIG. 4 shows the latch arrangement of FIG. 1 wherein an attempt has been made to open the latch whilst in a locked condition.

Thus operation of an inside or outside door handle will cause the release lever 26 to rotate in a clockwise direction as shown in FIG. 1 which will result in end 28A of release link 28 immediately disengaging pin 37 such that the release lever 26, release link 28 and connector 30 moves to the position as shown in FIG. 4.

It should be noted that whilst abutment 22 has being caused to move, in view of the fact that it was initially mis-aligned with pawl pin 14, such movement has resulted in abutment 22 bypassing pawl pin 14 and not imparting any movement to pawl pin 14. Thus whilst the inside or outside handle has been moved, the door has not become unlatched. Note that in further embodiments it is possible to arrange an abutment such as abutment 22 to be permanently aligned with a latch release element such as pawl pin 14 but remote therefrom such that with the latch arrangement in a locked condition the abutment approaches the pawl pin but does not move it and with the latch arrangement in an unlocked condition the abutment approaches, engages and then moves the pawl pin.

It can be seen that with the control means in its second condition, the door latch remains in a locked condition.

With the control means in the first condition i.e. where there is no power to the windings 46 but the magnetic pawl 44 is in a position as shown in FIG. 1B, counterclockwise rotation of the lock/unlock lever is again prevented though this time by co-operation of abutments 39 and 58. Thus actuation of the inside or outside handles will again cause release lever 26, release link 28 and connector 30 to move to the position as shown in FIG. 4.

Consideration of FIG. 2 shows schematically a power actuator P which is independently operable to release the latch.

Further shown schematically is a coded security device 70 in the form of an externally mounted key barrel into which can be inserted a key. Actuation of the key barrel via the key is capable of moving the magnetic pawl between the positions shown in FIGS. 1A and 1B.

The latch arrangement is configured such that when the associated vehicle is in use the control means is set to its second condition i.e. power is maintained to the windings. Under such circumstances electric power lost to resistance in the windings 46 can be compensated for by the fact that the engine of the vehicle is running and hence the battery recharging system (such as an alternator) can recharge the battery to ensure it does not go flat.

When the vehicle is parked and left unattended the control means can be set to its first condition to lock the latch. Note that the first condition of the control system does not cause any drain to the vehicle battery.

The control mechanism can also be set to its third condition when the vehicle is parked and is required to be in an unlocked condition. Note that in the third condition there is no drain on the battery.

The control means can be changed between its first and third condition by applying a pulse of electrical power to the windings in an appropriate direction.

With the vehicle in use and the control means in its second condition, as mentioned above, the lock/unlock lever 32 is maintained in the position as shown in FIG. 1 by power being fed to the electromagnet. In the event of a power failure, such as might occur following a road traffic accident, the control means will by definition change to its third condition and hence the doors will become unlocked and occupants of the vehicle will be able to escape from the vehicle.

With the vehicle parked and with the control means in its first condition i.e. with the vehicle locked, a drained vehicle battery will prevent pulsing of the electromagnet to move the control means from the first and third condition to unlock the vehicle. However, it is nevertheless possible to manually unlock the vehicle by use of the key and key barrel 70. The key and key barrel can also be used to lock the vehicle if necessary.

It should be noted that only when the vehicle is in use is power continually fed to windings 46. When the vehicle is parked power is only momentarily fed to windings 46 to change between the locked and unlocked condition.

Such an arrangement therefore significantly reduces the likelihood of flattening the battery when the vehicle is parked but the nevertheless allows opening of the doors in the event of power loss following a road traffic accident.

It should be noted that the electromagnet 42 need only be strong enough to retain the lock/unlocked lever 32 in the position shown in FIG. 1 when the electromagnet is in its second condition when power is being supplied to the electromagnet. Thus the electromagnet has to be strong enough to overcome the forces in tension spring 60 during initial movement of inside or outside handle and it has to overcome the forces in tension spring 60 and 62 during a subsequent movement of the inside or outside handle. Note that the electromagnet is not required to be strong enough to move the lock/unlock lever from the position as shown in FIG. 2 to a position such that abutment 38 engages with the electromagnet.

As mentioned above the control means 18 has two ways of preventing rotation of the lock/unlock lever 32, namely by permanently energizing the windings 46 or by movement of magnetic pawl 44 to the position as shown in FIG. 1B. In further embodiments, in particular when no power release P is provided, the control means can be used to simply lock and unlock the vehicle e.g. when parked. As such it is only necessary for the windings 46 to be pulsed to move the magnetic between the positions as shown in FIGS. 1A and FIG. 1B. As such the electromagnet 42 is not required to attract lock/unlock lever 32 which can therefore be made of a non ferromagnetic material, such as a plastics material. Under these circumstances it is necessary to have a manual override system operable by the inside handle (but not the outside handle) such that when the inside handle is moved the magnetic pawl 44, if in the position as shown in FIG. 1B, is moved to the position as shown in FIG. 1A. Once the magnetic pawl is in the position as shown in FIG. 1A, the latch release mechanism 16 can then operate in its two stage manner i.e. alignment of abutment 22 with pawl pin 14 followed by movement of pawl pin 14 from position A to position B as shown in FIG. 1 to open the latch. Under such an arrangement it is preferable that the release mechanism 16 fully returns to the rest position upon release of the inside handle i.e. abutment 22 becomes mis-aligned with pawl pin 14.

The foregoing description is exemplary and not just a material specification. The invention has been described in an illustrative manner, and should be understood that the terminology used is intended to be in the nature of words of description rather than of limitation. Many modifications and variations of the present invention are possible in light of the above teachings. The preferred embodiments of this invention have been disclosed, however, one of ordinary skill in the art would recognize that certain modifications are within the scope of this invention. It is understood that within the scope of the appended claims, the invention may be practiced otherwise than as specifically described. For that reason the following claims should be studied to determine the true scope and content of this invention

What is claimed is:

1. A latch arrangement comprising;

a latch, a release mechanism, a manually actuable element, and a control element, the latch being operable to releasably retain a striker in usc, the release mechanism being capable of being moved by the manually actuable element from a rest position through an unlocked position to a release position wherein the release mechanism unlatches the latch, the control element having a locked condition at which actuation of the manually actuable element does not cause unlatching and an unlocked condition at which during an initial movement of the manually actuable element, the release mechanism achieves the unlocked position, and during subsequent movement of the manually actuable element, the release mechanism achieves the release position, the release mechanism comprising a release link having an abutment operable to move a latch release element, movement of the release mechanism with the control element in the unlocked condition causes the abutment to move in a first path, and movement of the release mechanism with the control element in the locked condition causes the abutment to move in a second path, differing from the first path, in which the first path passes through the unlocked position of the latch release element, wherein a part of the release mechanism is retained in the rest position by a control pawl to provide for the locked condition.

2. The latch arrangement as defined in claim 1 in which when the control element is in the locked condition, actuation of the manually actuable element moves the abutment, but the abutment does not move the latch release element.

3. The latch arrangement as defined in claim 1 in which the release link is operably movable by a release lever.

4. The latch arrangement as defined in claim 1 in which the locked condition can additionally be provided by said part of the release mechanism being retained by magnetic attraction.

5. The latch arrangement as defined in claim 1 in which the control element is movable between the locked and unlocked conditions by manual operation of a coded security device.

6. The latch arrangement as recited in claim 1, wherein a portion of said first path is transverse to said second path.

7. The latch arrangement as recited in claim 1, wherein said first path includes an arcuate portion and a linear portion parallel to a direction of movement of said release element.

8. The latch arrangement as recited in claim 1, wherein said first path includes a component transverse to said second path and a component substantially parallel to said second path.

9. The latch arrangement as recited in claim 1, wherein said first path includes an arcuate portion and a linear portion with the arcuate portion being transverse with the linear portion.

10. A latch arrangement comprising;

a latch, a release mechanism, a manually actuable element, and a control element, the latch being operable to releasably retain a striker in use, the release mechanism being capable of being moved by the manually actuable element from a rest position through an unlocked position to a release position wherein the manually actuable element unlatches the latch, the control element having a locked condition at which actuation of the manually actuable element does not cause unlatching and an unlocked condition at which during an initial movement of the manually actuable element, the release mechanism achieves the unlocked position, and during subsequent movement of the manually actuable element, the release mechanism achieves the release position, the release mechanism comprising a release link having an abutment operable to move a latch release element movement of the release mechanism with the control element in the unlocked condition causes the abutment to move in a first path, and movement of the release mechanism with the control element in the locked condition causes the abutment to move in a second path, differing from the first path, in which the first path passes through the unlocked position of the latch release element, wherein a part of the release mechanism is retained in the rest position by the control element to provide for the locked condition and said part of the release mechanism is a lock/unlock lever which is retained in a first position when the control element is in the locked condition and is allowed to be moved to a second position when the control element is in the unlocked condition.

11. The latch arrangement as defined in claim 10 in which the lock/unlock lever is connected to the release link by a connector.

12. The latch arrangement as defined in claim 11 in which the lock/unlock lever, connector and release link substantially move in unison during said initial movement of the manually actuable element.

13. The latch arrangement as defined in claim 12 in which the lock/unlock lever, connector and release link rotate about a pivot during said initial movement.

14. The latch arrangement as defined in claim 13 in which the pivot mounts the lock/unlock lever on a chassis of the latch arrangement.

15. The latch arrangement as defined in claim 13 in which the lock/unlock lever remains stationary during said subsequent movement of the manually actuable element.

16. The latch arrangement as recited in claim 10, in which said part of the release mechanism is retained by magnetic attraction.

17. The latch arrangement as recited in claim 10, wherein a part of the release mechanism is retained in the rest position by a control pawl to provide for the locked condition.

18. A latch arrangement comprising;

a latch, a release mechanism, a manually actuable element, and a control element, the latch being operable to releasably retain a striker in use, the release mechanism being capable of being moved by the manually actuable element from a rest position through an unlocked position to a release position wherein the manually actuable element unlatches the latch, the control element having a locked condition at which actuation of the manually actuable element does not cause unlatching and an unlocked condition at which during an initial movement of the manually actuable element, the release mechanism achieves the unlocked position, and during subsequent movement of the manually actuable element, the release mechanism achieves the release position, the release mechanism comprising a release link having an abutment operable to move a latch release element movement of the release mechanism with the control element in the unlocked condition causes the abutment to move in a first path, and movement of the release mechanism with the control element in the locked condition causes the abutment to move in a second path, differing from the first path, in which the first path passes through the unlocked position of the latch release element, wherein a part of the release mechanism is designed to return to the rest position from the release position upon release of the manually actuable element and the release mechanism is biased to the rest position by resilient member, the resilient member including a first resilient member biasing the release mechanism to the unlocked position from the released position and a second resilient member biasing the release mechanism to the rest position from the unlocked position.

19. A latch arrangement comprising:

a latch, a release mechanism, a manually actuable element, and a control element, the latch being operable to releasably retain a striker in use, the release mechanism being capable of being moved by the manually actuable element from a rest position through an unlocked position to a release position wherein the manually actuable element unlatches the latch, the control element having a locked condition at which actuation of the manually actuable element does not cause unlatching and an unlocked condition at which during an initial movement of the manually actuable element, the release mechanism achieves the unlocked position, and during subsequent movement of the manually actuable element, the release mechanism achieves the release position, the release mechanism comprising a release link having an abutment operable to move a latch release element, movement of the release mechanism with the control element in the unlocked condition causes the abutment to move in a first path, and movement of the release mechanism with the control element in the locked condition causes the abutment to move in a second path, differing from the first path, in which the first path passes through the unlocked position of the latch release element, wherein the latch is further movable between a latched and released position by a powered release actuator.

20. A latch arrangement comprising;

a latch, a release mechanism, a manually actuable element, and a control element, the latch being operable to releasably retain a striker in use, the release mechanism being capable of being moved by the manually actuable element from a rest position through an unlocked position to a release position wherein the release mechanism unlatches the latch, the release mechanism comprising a release link having an abutment movable along first and second paths and operable to move a latch release element, the first and second paths being different, the control element having a locked condition at which actuation of the manually actuable element moves the abutment along the second path and does not cause unlatching of the latch and an unlocked condition at which during an initial movement of the manually actuable element, the abutment moves along the first path generally arcuately so that the release mechanism achieves the unlocked position and during subsequent movement of the manually actuable element, the abutment moves along the first path generally linearly so that the release mechanism achieves the release position wherein a part of the release mechanism is retained in the rest position by a control pawl to provide for the locked condition.

21. The latch arrangement as recited in claim 20, in which said the locked condition can additionally be provided by part of the release mechanism being retained by magnetic attraction.

22. A latch arrangement comprising;

a latch, a release mechanism, a manually actuable element, and a control element, the latch being operable to releasably retain a striker in use, the release mechanism being capable of being moved by the manually actuable element from a rest position along a first path through an unlocked position to a release position wherein the release mechanism unlatches the latch, the control element having a locked condition at which actuation of the manually actuable element moves the release mechanism along a second path that does not cause unlatching of the latch and an unlocked condition at which during an initial movement of the manually actuable element, the release mechanism moves along the first path and achieves the unlocked position and during subsequent movement of the manually actuable element, the release mechanism achieves the release position in which a part of the release mechanism is held in the rest position by a magnet of the control element when the control element is in the locked condition thereby preventing the release mechanism from moving to the release position, and in which said part of the release mechanism is not held in the rest position by the magnet when the control element is in the unlocked condition, thereby allowing the release mechanism to move to the release position wherein the locked condition can additionally he provided by the part of the release mechanism being retained in the rest position by a control pawl to provide for the locked condition.

23. A latch for a vehicle door comprising:

a manually actuable element;

a release mechanism movable by said manually actuable element from a rest position through an unlocked position to a release position wherein said release mechanism unlatches said latch, said release mechanism comprises a release link having an abutment operable to move along a first path aligned with a latch release element and a second path mis-aligned with said latch release element, wherein movement of said abutment along said first path is different than movement of said abutment along said second path; and a control element having a locked condition at which actuation of said manually actuable element does not cause unlatching of said latch and an unlocked condition where initial movement of said manually actuable element causes said abutment of said release link to align with said latch release element such that during subsequent movement of said manually actuable element, said release mechanism is moved to said release position, wherein part of said release mechanism is retained in said rest position by a control pawl to provide for said locked condition.

24. The latch as recited in claim 23, wherein said release mechanism further comprises a lock arm pivotal about a first pivot when said control element is in said unlocked condition, and said lock arm is fixed when said control element is in said locked condition.

25. The latch as recited in claim 24, wherein said release link is movable along said first path into alignment with said latch release element with said lock arm pivotal about said first pivot, and movable along said second path into a mis-aligned position with said latch release element when said lock arm is fixed.

26. The latch as recited in claim 23, wherein said control element comprises a magnet.

27. The latch as recited in claim 23, further comprising a biasing member biasing said release mechanism toward said rest position.

28. The latch as recited in claim 23, wherein a portion of said first path is transverse to said second path.

29. The latch as recited in claim 23, wherein said first path includes an arcuate portion and a linear portion parallel to a direction of movement of said latch release element.

30. The latch as recited in claim 23, wherein said first path includes a component transverse to said second path and a component substantially parallel to said second path.

31. The latch as recited in claim 23, wherein said first path includes an arcuate portion and a linear portion with the arcuate portion being transverse with the linear portion.

32. The latch as recited in claim 23, in which said locked condition can additionally be provided by part of the release mechanism being retained by magnetic attraction.

33. A latch arrangement comprising;

a latch, a release mechanism, a manually actuable element, and a control element, the latch being operable to releasably retain a striker in use, the release mechanism being capable of being moved by the manually actuable element from a rest position through an unlocked position to a release position wherein the release mechanism unlatches the latch, the release mechanism comprising a release link having an abutment movable along first and second paths and is operable to move a latch release element, the first and second paths being different, the control element having a locked condition at which actuation of the manually actuable element moves the abutment along the second path and does not cause unlatching of the latch and an unlocked condition at which during an initial movement of the manually actuable element, the abutment moves along the first path generally arcuately so that the release mechanism achieves the unlocked position and during subsequent movement of the manually actuable element, the abutment moves along the first path generally linearly so that the release mechanism achieves the release position, wherein a pan of the release mechanism is retained in the rest position by the control element to provide for the locked condition and said pan of the release mechanism is a lock/unlock lever which is retained in a first position when the control element is in the locked condition and is allowed to be moved to a second position when the control element is in the unlocked condition.

34. The latch arrangement as recited in 33, in which said part of the release mechanism is retained by magnetic attraction.

35. The latch arrangement as recited in claim 33, wherein a part of the release mechanism is retained in the rest position by a control pawl to provide for the locked condition.

36. A latch arrangement comprising;

a latch, a release mechanism, a manually actuable element, and a control element, the latch being operable to releasably retain a striker in use, the release mechanism being capable of being moved by the manually actuable element from a rest position through an unlocked position to a release position wherein the release mechanism unlatches the latch, the release mechanism comprising a release link having an abutment movable along first and second paths and operable to move a latch release element, the first and second paths being different, the control element having a locked condition at which actuation of the manually actuable element moves the abutment along the second path and does not cause unlatching of the latch and an unlocked condition at which during an initial movement of the manually actuable element, the abutment moves along the first path generally arcuately so that the release mechanism achieves the unlocked position and during subsequent movement of the manually actuable element, the abutment moves along the first path generally linearly so that the release mechanism achieves the release position, wherein the release mechanism is designed to return to the rest position from the release position upon release of the manually actuable element and the release mechanism is biased to the rest position by a resilient member in which the resilient member includes a first resilient member biasing the release mechanism to the unlocked position from the release position and a second resilient member biasing the release mechanism to the rest position from the unlocked position.

37. A latch arrangement comprising;

a latch, a release mechanism, a manually actuable element, and a control element, the latch being operable to releasably retain a striker in use, the release mechanism being capable of being moved by the manually actuable element from a rest position through an unlocked position to a release position wherein the release mechanism unlatches the latch, the release mechanism comprising a release link having an abutment movable along first and second paths and operable to move a latch release element, the first and second paths being different, the control element having a locked condition at which actuation of the manually actuable element moves the abutment along the second path and does not cause unlatching of the latch and an unlocked condition at which during an initial movement of the manually actuable element, the abutment moves along the first path generally arcuately so that the release mechanism achieves the unlocked position and during subsequent movement of the manually actuable element the abutment moves along the first path generally linearly so that the release mechanism achieves the release position, wherein the latch is further movable between a latched and released position by a powered release actuator.

38. A latch arrangement comprising;

a latch, a release mechanism, a manually actuable element and a control element, the latch being operable to releasably retain a striker in use, the release mechanism being capable of being moved by the manually actuable element from a rest position along a first path through an unlocked position to a release position wherein the release mechanism unlatches the latch, the control element having a locked condition at which actuation of the manually actuable element moves the release mechanism along a second path that does not cause unlatching of the latch and an unlocked condition at which during an initial movement of the manually actuable element, the release mechanism moves along the first path and achieves the unlocked position and during subsequent movement of the manually actuable element, the release mechanism achieves the release position in which a pan of the release mechanism is held in the rest position by a magnet of the control element when the control element is in the locked condition thereby preventing the release mechanism from moving to the release position, and in which said part of the release mechanism is not held in the rest position by the magnet when the control element is in the unlocked condition, thereby allowing the release mechanism to move to the release position, wherein a part of the release mechanism is retained in the rest position by the control element to provide for the locked condition and said part of the release mechanism is a lock/unlock lever which is retained in a first position when the control element is in the locked condition and is allowed to be moved to a second position when the control element is in the unlocked condition.

39. The latch as recited in claim 38, in which said locked condition can additionally be provided by a part of the release mechanism being retained in the rest position by a control pawl to provide for the locked condition.

40. A latch arrangement comprising;

a latch, a release mechanism, a manually actuable element and a control element, the latch being operable to releasably retain a striker in use, the release mechanism being capable of being moved by the manually actuable element from a rest position along a first path through an unlocked position to a release position wherein the release mechanism unlatches the latch, the control element having a locked condition at which actuation of the manually actuable element moves the release mechanism along a second path that does not cause unlatching of the latch and an unlocked condition at which during an initial movement of the manually actuable element, the release mechanism moves along the first path and achieves the unlocked position and during subsequent movement of the manually actuable element, the release mechanism achieves the release position in which a part of the release mechanism is held in the rest position by a magnet of the control element when the control element is in the locked condition thereby preventing the release mechanism from moving to the release position, and in which said part of the release mechanism is not held in the rest position by the magnet when the control element is in the unlocked condition, thereby allowing the release mechanism to move to the release position, wherein the release mechanism is designed to return to the rest position from the release position upon release of the manually actuable element and the release mechanism is biased to the rest position by a resilient member, the resilient member including a first resilient member biasing the release mechanism to the unlocked position from the release position and a second resilient member biasing the release mechanism to the rest position from the unlocked position.

41. A latch arrangement comprising;

a latch, a release mechanism, a manually actuable element and a control element, the latch being operable to releasably retain a striker in use, the release mechanism being capable of being moved by the manually actuable element from a rest position along a first path through an unlocked position to a release position wherein the release mechanism unlatches the latch, the control element having a locked condition at which actuation of the manually actuable element moves the release mechanism along a second path that does not cause unlatching of the latch and an unlocked condition at which during an initial movement of the manually actuable element, the release mechanism moves along the first path and achieves the unlocked position and during subsequent movement of the manually actuable element, the release mechanism achieves the release position in which a pan of the release mechanism is held in the rest position by a magnet of the control element when the control element is in the locked condition thereby preventing the release mechanism from moving to the release position, and in which said part of the release mechanism is not held in the rest position by the magnet when the control element is in the unlocked condition, thereby allowing the release mechanism to move to the release position, wherein the latch is further movable between a latched and released position by a powered release actuator.

42. A latch for a vehicle door comprising:

a manually actuable element;

a release mechanism movable by the manually actuable element from a rest position through an unlocked position to a release position wherein said release mechanism unlatches said latch, said release mechanism comprises a release link having an abutment operable to move along a first path aligned with a latch release element and a second path mis-aligned with said latch release element, wherein movement of said abutment along said first path is different than movement of said abutment along said second path; and a control element having a locked condition at which actuation of said manually actuable element does not cause unlatching of said latch and an unlocked condition where initial movement of said manually actuable element causes said abutment of said release link to align with said latch release element such that during subsequent movement of said manually actuable element, said release mechanism is moved to said release position in which said first path passes through said unlocked position of said latch release element, wherein a part of the release mechanism is retained in the rest position by said control element to provide for said locked condition and said part of said release mechanism is a lock/unlock lever which is retained in a first position when said control element is in said locked condition and is allowed to be moved to a second position when said control element is in said unlocked condition.

43. The latch of claim 42, in which said part of the release mechanism is retained by magnetic attraction.

44. The latch as recited in claim 42, wherein a part of the release mechanism is retained in the rest position by a control pawl to provide for the locked condition.

45. A latch for a vehicle door comprising:

a manually actuable element;

a release mechanism movable by the manually actuable element from a rest position through an unlocked position to a release position wherein the release mechanism unlatches the latch, said release mechanism comprises a release link having an abutment operable to move along a first path aligned with a latch release element and a second path mis-aligned with said latch release element, wherein movement of said abutment along said first path is different than movement of said abutment along said second path; and a control element having a locked condition at which actuation of said manually actuable element does not cause unlatching of said latch and an unlocked condition where initial movement of said manually actuable element causes said abutment of said release link to align with said release element such that during subsequent movement of said manually actuable element, said latch release mechanism is moved to said release position, wherein said release mechanism is designed to return to the rest position from the release position upon release of said manually actuable element and said release mechanism is biased to said rest position by a resilient member in which said resilient member includes a first resilient member biasing said release mechanism to said unlocked position from said release position and a second resilient member biasing said release mechanism to said rest position from said unlocked position.

46. A latch for a vehicle door comprising:

a manually actuable element;

a release mechanism movable by the manually actuable element from a rest position through an unlocked position to a release position wherein said release mechanism unlatches said latch, said release mechanism comprises a release link having an abutment operable to move along a first path aligned with a latch release element and a second path mis-aligned wit said latch release element, wherein movement of said abutment along said first path is different than movement of said abutment along said second path; and a control element having a locked condition at which actuation of said manually actuable element does not cause unlatching of said latch and an unlocked condition where initial movement of said manually actuable element causes said abutment of said release link to align with said latch release element such that during subsequent movement of said manually actuable element, said latch release mechanism is moved to said release position, wherein said latch is further movable between a latched and a released position by a powered release actuator.

* * * * *

UNITED STATES PATENT AND TRADEMARK OFFICE

CERTIFICATE OF CORRECTION

PATENT NO. : 7,070,212 B2
APPLICATION NO. : 10/024915
DATED : July 4, 2006
INVENTOR(S) : Nigel Victor Spurr It is certified that error appears in the above-identified patent and that said Letters Patent is hereby corrected as shown below:

Claim 1, Column 6, line 66: “usc”should read --use--

Claim 18, Column 8, lines 44-45: “manually actuable element” should be --release mechanism--

Claim 18, Column 8, line 62: Please delete “a part of”

Claim 19, Column 9, lines 11-12: “manually actuable element” should be --release mechanism--

Claim 22, Column 10, line 20: “he” should be --be--

Claim 33, Column 11, line 32: “pan” should be --part--

Claim 33, Column 11, line 34: “pan” should be --part--

Claim 38, Column 12, line 54: “pan” should be --part--

Claim 41, Column 13, line 62: “pan” should be --part--

Claim 46, Column 15, line 14: “wit” should be --with--

Signed and Sealed this

Twenty-first Day of November, 2006

JON W. DUDAS
*Director of the United States Patent and Trademark Office*